US005987667A

United States Patent [19]

Haverly et al.

[11] Patent Number: 5,987,667

[45] Date of Patent: Nov. 23, 1999

[54] CONVERTIBLE BLANKET AND PILLOW

[76] Inventors: Shirley Mae Haverly, 18203 Milmore Ave., Carson, Calif. 90746; R. Joseph Trojan, 4148 Inglewood #203, Mar Vista, Calif. 90006; Shelly S. Maurer, 2455 Vista Wood Cir., #21, Thousand Oaks, Calif. 91362

[21] Appl. No.: 09/232,058

[22] Filed: Jan. 15, 1999

[51] Int. Cl.[6] ..... A47G 9/00

[52] U.S. Cl. ..... 5/485; 5/502; 5/417

[58] Field of Search ..... 5/417, 420, 485, 5/502, 418, 419

[56] References Cited

U.S. PATENT DOCUMENTS

| | | | |
|---|---|---|---|
| D. 258,035 | 1/1981 | Fenwick . | |
| D. 338,586 | 8/1993 | Dolan . | |
| D. 390,057 | 2/1998 | Gower . | |
| 924,893 | 6/1909 | Duddridge . | |
| 1,269,276 | 6/1918 | Harris . | |
| 1,343,881 | 6/1920 | Christensen . | |
| 2,038,335 | 4/1936 | Aronow . | |
| 2,045,784 | 6/1936 | Leve . | |
| 2,183,418 | 12/1939 | Williams . | |
| 2,344,010 | 3/1944 | Walsh . | |
| 2,898,609 | 8/1959 | Storie . | |
| 3,774,249 | 11/1973 | Ybarra et al. . | |
| 4,087,874 | 5/1978 | Callaway et al. . | |
| 4,237,380 | 12/1980 | Silvestri | 5/417 |
| 4,375,111 | 3/1983 | Hall . | |
| 4,516,668 | 5/1985 | Grayek . | |
| 4,590,633 | 5/1986 | Pickens . | |
| 4,634,618 | 1/1987 | Greer et al. . | |
| 4,754,512 | 7/1988 | Chao-Yang . | |
| 4,856,131 | 8/1989 | Mills . | |
| 4,967,986 | 11/1990 | Schildkraut . | |
| 4,991,245 | 2/1991 | Franco . | |
| 5,179,741 | 1/1993 | Book . | |
| 5,199,120 | 4/1993 | Holmes . | |
| 5,457,829 | 10/1995 | Elliot . | |
| 5,535,467 | 7/1996 | Ciske . | |
| 5,629,071 | 5/1997 | Feldman | 5/417 X |
| 5,850,643 | 12/1998 | Brumfield | 5/485 X |

*Primary Examiner*—Michael F. Trettel
*Attorney, Agent, or Firm*—Trojan Law Offices

[57] ABSTRACT

A blanket having one pocket permanently attached to the top planar surface along one elongated edge thereof and a plurality of additional pockets permanently attached to either the top or bottom planar surface, each along one an elongated edge thereof such that only one pocket is present along any elongated edge, the inside surfaces of the pockets consisting of different fabric patterns from each other, and which pockets are shaped and dimensioned such that when one of the pockets is turned inside out the remainder of the blanket can be folded, rolled and tucked into the pocket to convert the blanket into a pillow.

14 Claims, 4 Drawing Sheets

CONVERTIBLE BLANKET AND PILLOW

BACKGROUND OF THE INVENTION

1. Field of the Invention

This invention relates to a blanket that converts into a pillow.

2. Background of the Invention

Compact storage of blankets and pillows has been attained through many different methods. Most such devices use either a separate cover or bag in which the folded blanket can be place. The use of such means makes it easy for the user to misplace the cover or bag. Other known means for converting a blanket to a pillow require the use of zippers, drawstrings, snaps, or other such means to retain the blanket in its pillow form. However, the blanket may lose some of its comfort through the use of means such as bulky zippers and snaps. Further, these means can detract from the decorative nature of the converted blankets.

The purpose of this invention is to provide a blanket that can convert into a pillow without the need for additional covers or the use of hard or bulky fasteners. Additionally, the invention provides the user with multiple decorative options, which is not present in the known art.

One convertible comforter in the known art is disclosed in U.S. Pat. No. 5,457,829 to Elliot. This substantially rectangular comforter is quilted and includes a pocket 16 formed from a substantially rectangular piece of unquilted material fixed to the front side of the comforter 12 at the center of the shorter edge 13. The comforter converts by turning the pocket 16 inside out and folding, rolling and tucking the remainder of the comforter into the inverted pocket. This comforter provides the user with only a single option with regard to the decorative look of the comforter in its pillow form. Therefore, there still exists a need for an easily convertible comforter that provides multiple decorative options to the user.

SUMMARY OF THE INVENTION

The present invention is directed to a convertible blanket and pillow which satisfies the need identified above: easily convertible from the blanket form to the pillow form without the use of additional covers or fasteners and providing the user with multiple decorative options when the blanket is converted into a pillow. The preferred version of the invention includes: i) a blanket having a substantially rectangular shape which can be quilted; ii) multiple pockets formed by a substantially square or rectangular piece of fabric with lesser proportions than the base blanket secured along the long edges of the front and/or back side of the blanket; a different fabric pattern on the interior of each pocket.

When folded properly, a pocket, which is turned inside out, provides a receptacle for the remainder of the blanket to form the pillow form of the invention. Having multiple pockets, each with a different interior fabric design, provides the user with multiple decorative options for the pillow form depending upon the pocket into which the user chooses to fold the remainder of the blanket.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which.

DETAILED DESCRIPTION OF THE PREFERRED EMBODIMENT

Figure 1:
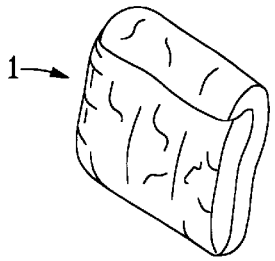
FIG. 1 is a view of the invention in use in its pillow form.
Figure 2:
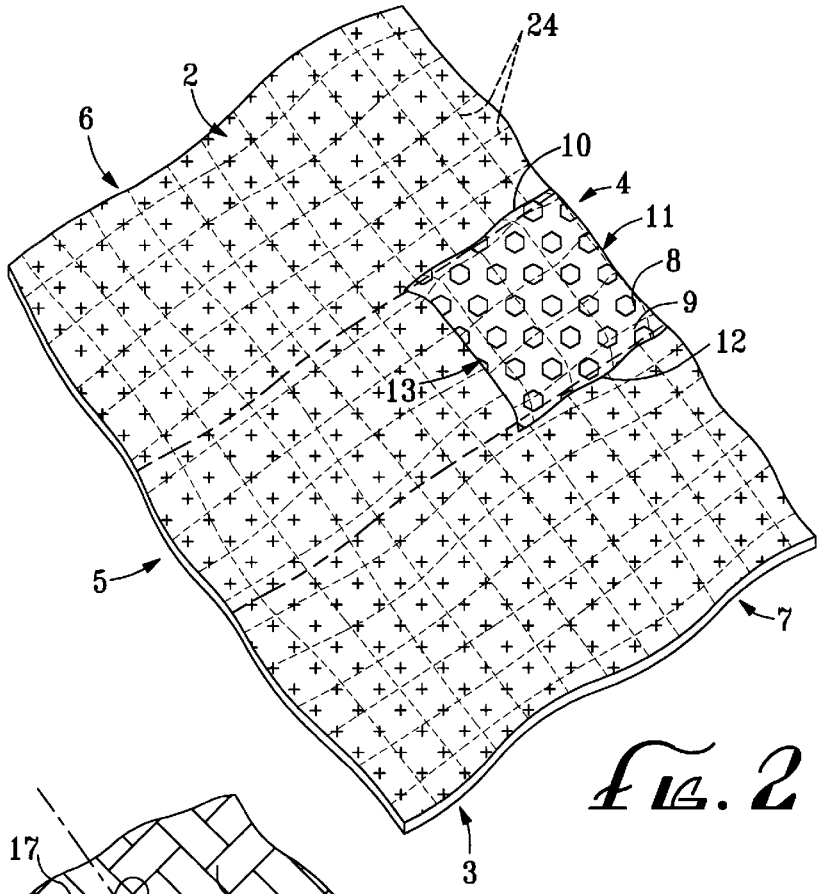
FIG. 2 is a view of the invention in use in its blanket form.

FIG. 1 illustrates the present invention 1, a convertible blanket and pillow, in its pillow form. FIG. 2 illustrates the present invention in its blanket form, having a top planar surface 2 and a bottom planar surface 3. The blanket portion is formed having first 4 and second 5 oppositely disposed elongated edges and third 6 and fourth 7 oppositely disposed edges which are shorter in length than the first and second edges (4, 5).

Secured to the top planar surface 2 of the blanket portion, along either the first 4 or second 5 elongated edge, is a first pocket panel 8. Pocket panel 8 is secured so that it is centered along the elongated edge (4 or 5) to which it is attached. Pocket panel 8 has a top planar surface 9 and side edges 10–13 which are shorter than oppositely disposed edges 4–7. Three edges 10–12 of pocket panel 8 are secured to the blanket portion, with side edge 13 left unsecured. This forms a space between pocket panel 8 and the top planar surface 2 with the opening facing elongated edge 5 of the blanket portion which is opposite the elongated edge 4 to which pocket panel 8 is secured.

Figure 3:
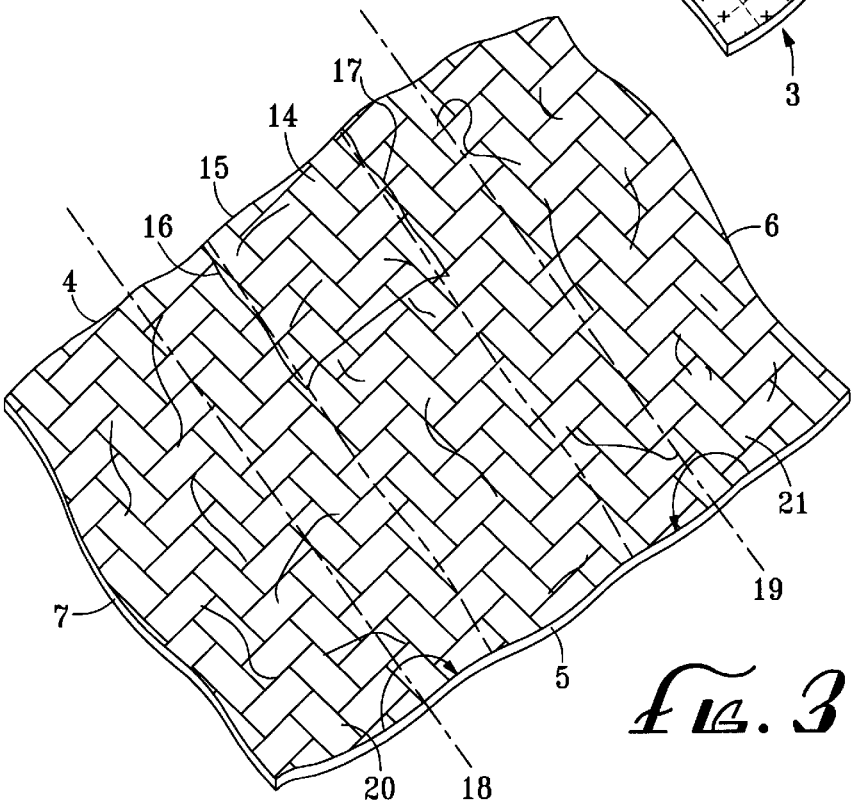
FIG. 3 is a view of the invention in blanket form prior to conversion to pillow form and showing the approximate fold lines for conversion.

FIG. 3 shows the bottom planar surface 3 of the blanket portion having the same configuration as top planar surface 2. Specifically, a second pocket panel 14 is secured along three of its edges 15 through 17 to either the first 4 or second 5 elongated edge such that a space is formed between second pocket panel 14 and the bottom planar surface 3 of the blanket portion.

Figure 4:
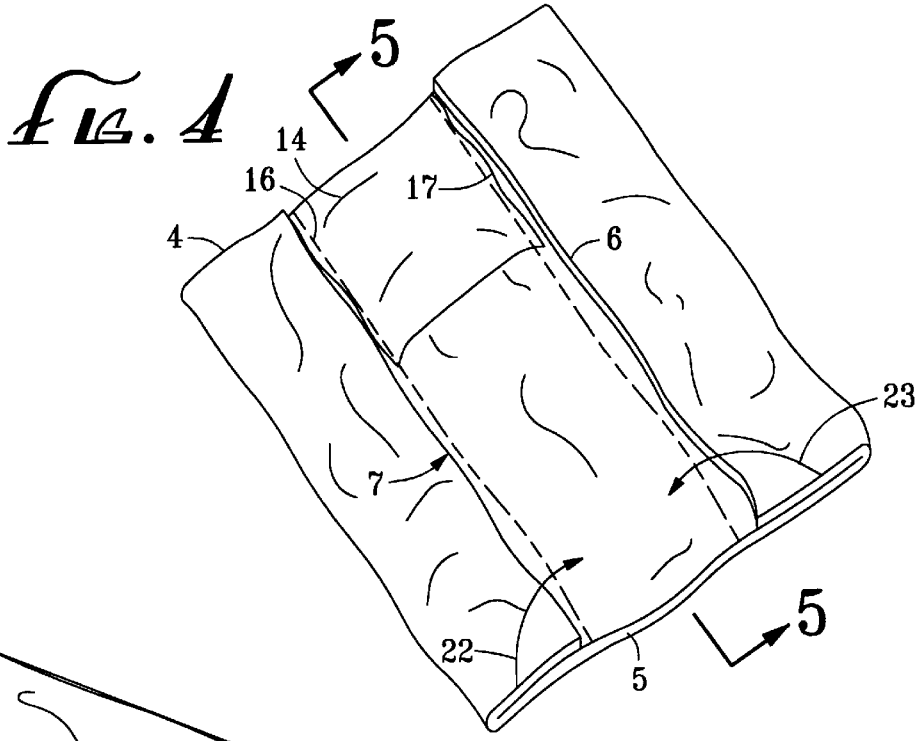
FIG. 4 is a top axial view of the invention showing the first folds for conversion to pillow form.
Figure 6:
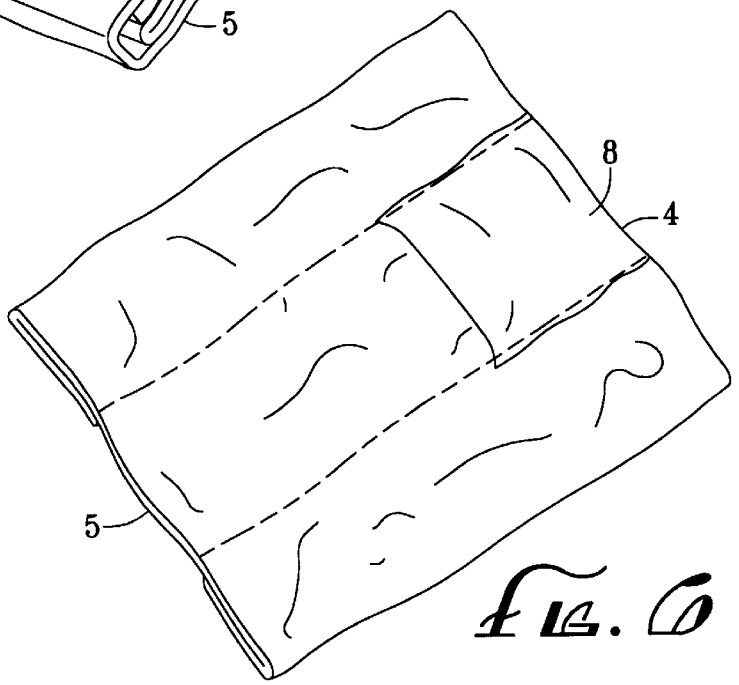
FIG. 6 is a bottom axial view of the invention after partial conversion from blanket to pillow after completion of the first set of folds.
Figure 5:
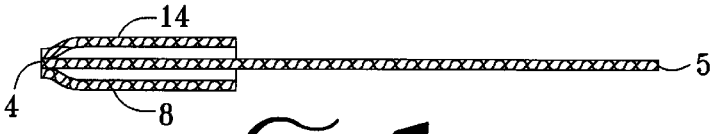
FIG. 5 is a cross-sectional view of the invention after partial conversion from blanket to pillow after completion of the first set of folds.

Conversion of invention from the blanket configuration to the pillow configuration is accomplished by a series of folds. Depicted in FIG. 3 is a set of folds 18 and 19, located substantially half way between edges 16 and 17 of second pocket panel 14 and oppositely disposed edges 6 and 7, along which oppositely disposed edges 6 and 7 are folded toward second pocket panel 14 as indicated by 20 and 21. FIG. 4 shows the configuration of the invention upon completion of the first set of folds. FIG. 6 shows the configuration of the invention from the opposite side of the blanket after completion of the first set of folds.

Figure 7:
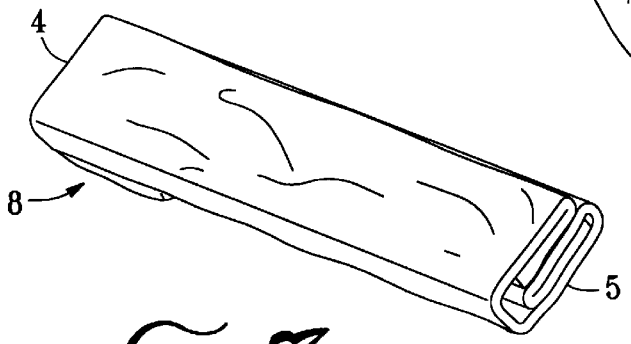
FIG. 7 is a top axial view of the invention after partial conversion from blanket to pillow after completion of the second set of folds.
Figure 8:
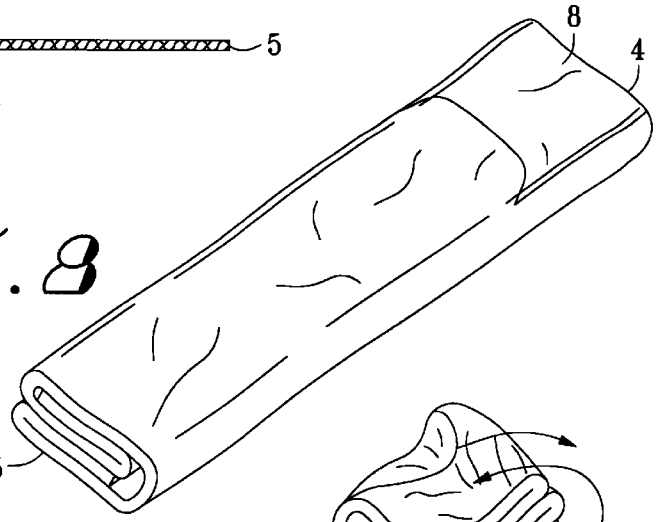
FIG. 8 is a bottom axial view of the invention after partial conversion from blanket to pillow after completion of the second set of folds.

The second set of folds is made along edges 16 and 17 of second pocket panel 14, as indicated by 22 and 23 in FIG. 4, such that the portion of the blanket between edges 16 and 17 of second pocket panel 14 and side edges 6 and 7 are folded onto second pocket panel 14. FIG. 7 shows the configuration of the invention upon completion of the second set of folds, such that pocket panel 8 is exposed on the opposite side of the blanket from the folds. FIG. 8 shows the configuration of the invention from the opposite side of the blanket after completion of the second set of folds.

Figure 9:
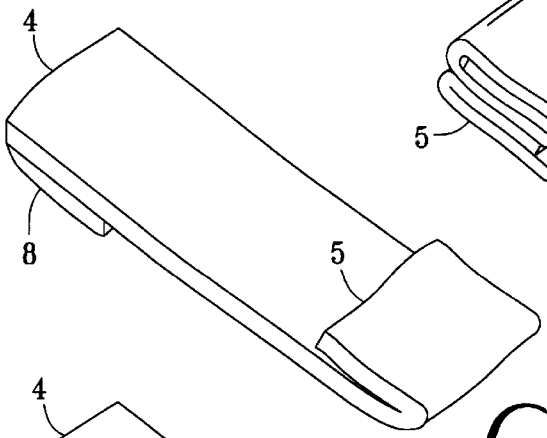
FIG. 9 is a top axial view of the invention after partial conversion from blanket to pillow after completion of the third set of folds.
Figure 12:
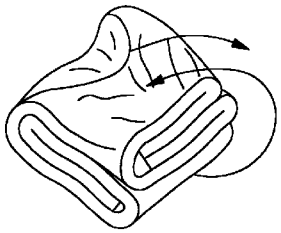
FIG. 12 is a top axial view of the invention after partial conversion from blanket to pillow indicating the direction of the pocket inversion to complete the conversion.
Figure 10:
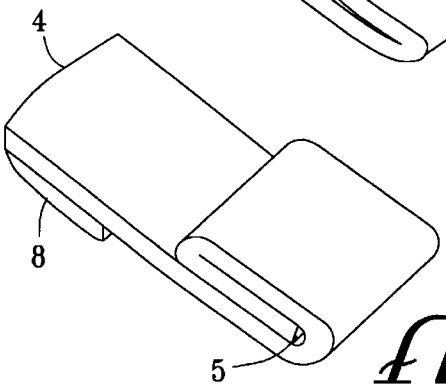
FIG. 10 is a top axial view of the invention after partial conversion from blanket to pillow after completion of the fourth set of folds.
Figure 11:
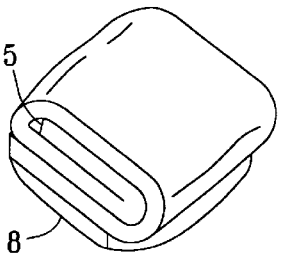
FIG. 11 is a top axial view of the invention after partial conversion from blanket to pillow after completion of the fifth set of folds.

As depicted in FIGS. 9–11, through a series of additional folds side edge 5 is folded toward side edge 8 such that the top area surface of the blanket is substantially the same as the area surface of pocket panel 8.

Figure 13:
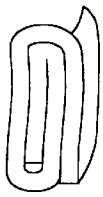
FIG. 13 is a side view of the invention after completion of the fifth set of folds and prior to pocket inversion to complete the conversion.
Figure 14:
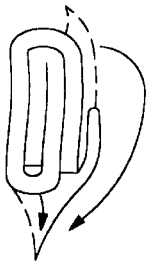
FIG. 14 is a side view of the invention after partial conversion from blanket to pillow indicating the direction of the pocket inversion to complete the conversion.
Figure 15:
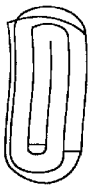
FIG. 15 is a transparent side view of the invention upon completion of the conversion from blanket to pillow.

As shown in FIGS. 13 through 15, to completely convert the invention into its pillow configuration, pocket panel 8 is then inverted over the remainder of the blanket such that the remainder of the blanket is placed within the space between inverted pocket panel 8 and the blanket. The blanket and pocket panels can be quilted 24 (FIG. 2).

Figure 16:
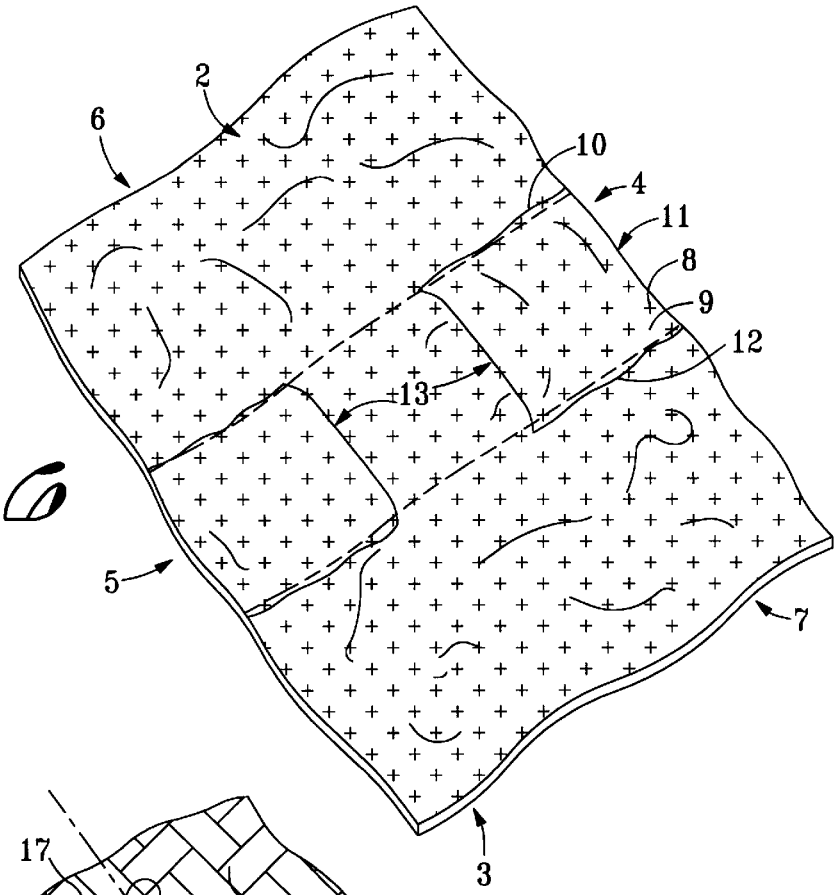
FIG. 16 is a top axial view of the invention in the alternative embodiment.
Figure 17:
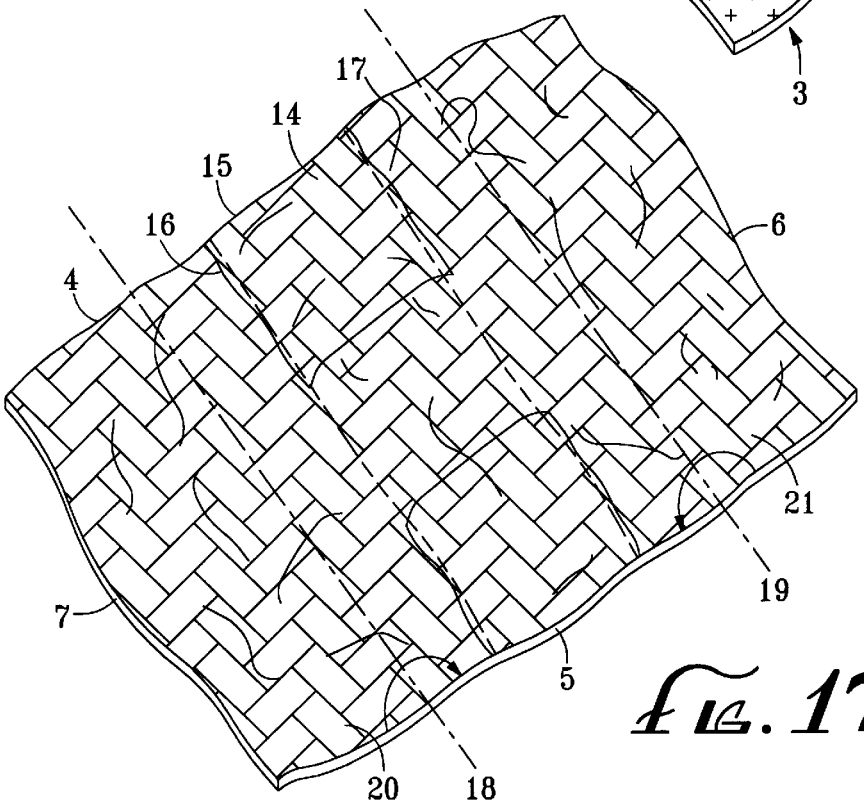
FIG. 17 is a bottom axial view of the invention in the alternative embodiment.

Although the present invention has been described in considerable detail with reference to certain preferred versions thereof, other versions are possible. For example, as shown in FIGS. 16 and 17, additional pocket panels can be placed along oppositely disposed edges 6 and 7 such that a total of four different pocket panels are available into which the blanket can be folded. The interior surface of each such pocket panel can have a different fabric pattern 11 (FIG. 2) and 11 (FIG. 16) thereby giving the user four different decorative pillow options. Therefore, the spirit and scope of the appended claims should not be limited to the description of the preferred versions contained herein.

What is claimed is:

1. A convertible blanket and pillow comprising:

a blanket having a top planar surface and a bottom planar surface, first and second oppositely disposed elongated edges and third and fourth oppositely disposed edges which are shorter than said first and second elongated edges;

a first pocket panel secured to said top planar surface of said blanket along either said first or said second elongated edge, said pocket panel having a top face and a bottom face and having four side edges, said side edges being shorter than said oppositely disposed edges of said blanket, said pocket panel being secured to said blanket along three of said side edges so as to form an opening between said top planar surface and said pocket panel, said opening facing toward the elongated edge which is opposite to said elongated edge to which said pocket panel is secured, said pocket panel being secured such that it is centered along said elongated edge to which it is secured; and a second pocket panel having the same construction as said first pocket panel, said second pocket panel being secured to said bottom planar surface of said blanket along either said first or said second elongated edge of said bottom planar surface in the same configuration as said first pocket panel.

2. The convertible blanket and pillow of claim 1 wherein said blanket is quilted.

3. The convertible blanket and pillow of claim 1 wherein said pocket panels are quilted.

4. The convertible blanket and pillow of claim 1 wherein said blanket and said pocket panels are quilted.

5. The convertible blanket and pillow of claim 1 wherein said bottom face of said first pocket panel consists of a different fabric pattern than the bottom face of said second pocket panel.

6. A convertible blanket and pillow comprising:

a blanket having a top planar surface and a bottom planar surface, first and second oppositely disposed elongated edges and third and fourth oppositely disposed edges which are shorter than said first and second elongated edges;

a plurality of pocket panels secured to either said top planar surface or said bottom planar surface along either said first or said second elongated edge, each of said pocket panels having a top face and a bottom face and having four side edges, said side edges being shorter than said oppositely disposed elongated edges, each of said pocket panels being secured to said blanket along three of said side edges so as to form an opening between said top or bottom planar surface and said pocket panels, said openings facing toward the elongated edge opposite to said elongated edge to which each of said pocket panels is secured, said pocket panels being secured such that only a single pocket panel is secured along any of said elongated edges of said top planar and said bottom planar surfaces, said pocket panels being secured such that they are centered along said elongated edges.

7. The convertible blanket and pillow of claim 6 wherein said blanket is quilted.

8. The convertible blanket and pillow of claim 6 wherein said pocket panels are quilted.

9. The convertible blanket and pillow of claim 6 wherein said blanket and said pocket panels are quilted.

10. The convertible blanket and pillow of claim 6 wherein said bottom face of each pocket panel consists of a different fabric pattern than the bottom face of every other pocket panel.

11. A convertible blanket and pillow comprising:

a blanket having a top planar surface and a bottom planar surface, first and second oppositely disposed elongated edges and third and fourth oppositely disposed edges which are shorter than said first and second elongated edges;

a first pocket panel secured to said top planar surface of said blanket along either said first or said second elongated edge, said pocket panel having a top face and a bottom face and having four side edges, said side edges being shorter than said oppositely disposed edges of said blanket, said pocket panel being secured to said blanket along three of said side edges so as to form an opening between said said top planar surface and said pocket panel, said opening facing toward the elongated edge opposite to said elongated edge to which said pocket panel is secured, said pocket panel being secured such that it is centered along said elongated edge to which it is secured;

a second pocket panel having the same construction as said first pocket panel, said second pocket panel being secured to said bottom planar surface of said blanket along either said first or said second elongated edge of said bottom planar surface in the same configuration as said first pocket panel; and wherein said bottom face of said first pocket panel consists of a different fabric pattern than the bottom face of said second pocket panel.

12. The convertible blanket and pillow of claim 11 wherein said blanket is quilted.

13. The convertible blanket and pillow of claim 11 wherein said pocket panels are quilted.

14. The convertible blanket and pillow of claim 11 wherein said blanket and said pocket panels are quilted.

* * * * *